United States Patent [19]

Etoh et al.

[11] 4,344,393

[45] Aug. 17, 1982

[54] INTERNAL COMBUSTION ENGINE

[75] Inventors: Yukihiro Etoh, Yokohama; Toshiaki Tanaka, Fujisawa; Fukashi Sugasawa, Yokohama; Haruhiko Iizuka, Yokosuka, all of Japan

[73] Assignee: Nissan Motor Company, Limited, Yokohama, Japan

[21] Appl. No.: 161,369

[22] Filed: Jun. 20, 1980

[30] Foreign Application Priority Data

Jun. 22, 1979 [JP] Japan ..... 54-78699

[51] Int. Cl.[3] ..... F02B 77/00; F02D 17/02

[52] U.S. Cl. ..... 123/198 F; 123/481

[58] Field of Search ..... 123/198 F, 481

[56] References Cited

U.S. PATENT DOCUMENTS

| | | | |
|---|---|---|---|
| 4,249,374 | 2/1981 | Sugasawa | 123/198 F |
| 4,284,056 | 8/1981 | Sugasawa | 123/198 F |

FOREIGN PATENT DOCUMENTS

| | | | |
|---|---|---|---|
| 2010793 | 10/1970 | Fed. Rep. of Germany | 123/198 F |
| 2628091 | 1/1977 | Fed. Rep. of Germany | 123/198 F |
| 2655461 | 6/1977 | Fed. Rep. of Germany | 123/198 F |
| 2752877 | 6/1978 | Fed. Rep. of Germany | 123/198 F |
| 2853455 | 6/1979 | Fed. Rep. of Germany | 123/198 F |
| 55-128634 | 4/1980 | Japan | 123/198 F |
| 55-78136 | 12/1980 | Japan | 123/198 F |

*Primary Examiner*—Ronald B. Cox

*Attorney, Agent, or Firm*—Schwartz, Jeffery, Schwaab, Mack, Blumenthal & Koch

[57] ABSTRACT

An internal combustion engine is disclosed which includes first and second cylinder units each including at least one cylinder, means for cutting off the supply of air and fuel to the second cylinder unit so as to render it inactive when the engine load is below a given value, a three-way catalytic converter for purifying the exhaust from the cylinders, a sensor exposed to the exhaust from the cylinders to provide a signal indicative of the air/fuel ratio at which the engine is operating, and means responsive to the signal from the sensor for controlling the fuel supplied to the engine to maintain the stoichiometric air/fuel ratio. Means is provided for introducing a predetermined amount of air into the second cylinder unit.

5 Claims, 5 Drawing Figures

INTERNAL COMBUSTION ENGINE

BACKGROUND OF THE INVENTION

1. Field of the Invention

This invention relates to an internal combustion engine of the split type operable on less than all of its cylinders when the engine load is below a given value and, more particularly, to such an internal combustion engine equipped with a NOx-reduction structure.

2. Description of the Prior Art

In general, internal combustion engines demonstrate higher efficiency and thus higher fuel economy when running under higher load conditions. In view of this fact, split type internal combustion engines have already been proposed which include split engine control means for cutting off the supply of fuel to some of the cylinders so as to render them inactive when the engine load is below a given value. This creates a relative increase in the load on the remainder cylinders, resulting in higher fuel economy at low load conditions.

One difficulty with such split type internal combustion engine is that during a split engine mode of operation, the initial combustion temperature in the active cylinders is increased while the exhaust gas temperature is reduced as compared to the temperatures which would exist during a full engine mode of operation at the same conditions. This result in an increase in the formation of NOx during a split engine mode of operation.

SUMMARY OF THE INVENTION

It is therefore an object of the present invention to provide an improved split type internal combustion engine which is extremely low in the emission of NOx particularly during a split engine mode of operation.

BRIEF DESCRIPTION OF THE DRAWINGS

The present invention will be described in greater detail by reference to the following description taken in connection with the accompanying drawings, in which.

DESCRIPTION OF THE PREFERRED EMBODIMENTS

Figure 1:
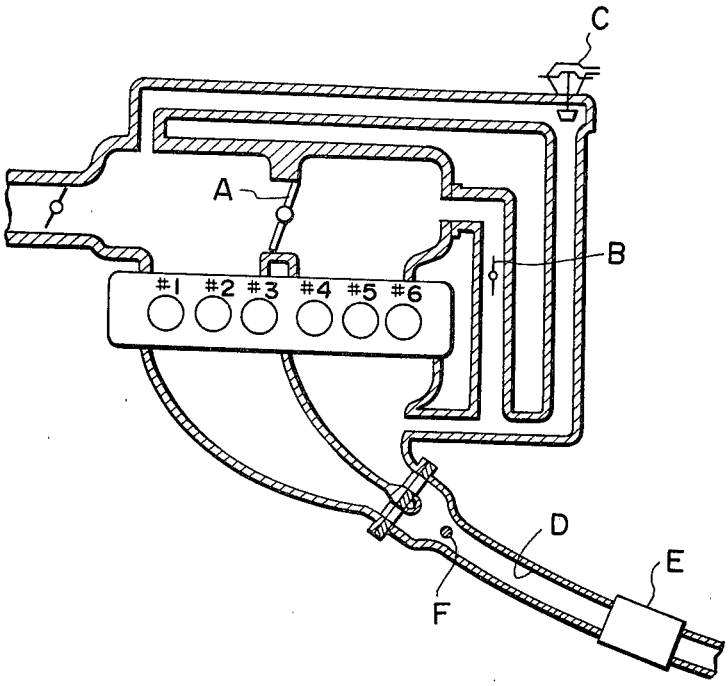
FIG. 1 (PRIOR ART)
FIG. 1 is a schematic sectional view showing a conventional split type internal combustion engine.

Prior to the description of the preferred embodiments of the present invention, we shall briefly describe the prior air split type internal combustion engine in FIG. 1 in order to specifically point out the difficulties attendant thereon.

Referring to FIG. 1, the engine is illustrated of the electronic controlled, fuel injection, 6-cylinder type engine including a first cylinder unit having three cylinders #1 to #3 and a second cylinder unit having three cylinders #4 to #6. When the engine operates at low loads and speeds, the fuel injection means associated with the second cylinder unit becomes inoperative to cut off the flow of fuel to the second cylinder unit and the stop valve A closes to shut off the flow of air to the second cylinder unit so as to place the engine operation in a split engine mode where the engine operates only on the first cylinder unit. During such a split engine mode of operation, the first EGR valve B opens to allow recirculation of exhaust gases, substantially at atmospheric pressure, into the second cylinder unit to reduce pumping losses therein and also the second EGR valve C opens to a predetermined degree to allow recirculation of a predetermined amount of exhaust gases into the first cylinder unit so as to suppress the combustion temperature therein for the reduction of NOx formation.

Under split engine operating conditions, although more efficient fuel combustion can be achieved, this results in higher initial combustion temperature and lower exhaust gas temperature than would exist during full engine mode of operation. Therefore, during split engine operation, there is a relative increase in the formation of NOx in each cylinder and exhaust gas temperature decreases in spite of exhaust gas recirculation.

In order to suppress the emission of NOx to ambient levels, there has been provided at a point downstream of the front tube D a three-way catalytic converter E which exhibits its maximum performance at the stoichiometric air/fuel ratio and at high temperatures. It is conventional practice to maintain the air/fuel ratio around the stoichiometric condition under feedback control of an air/fuel ratio sensor F provided in the front tube D and to maintain the front tube D at high temperatures by heat insulation thereof. However, the provision of such heat insulation results in an expensive and undurable exhaust system.

Figure 2:
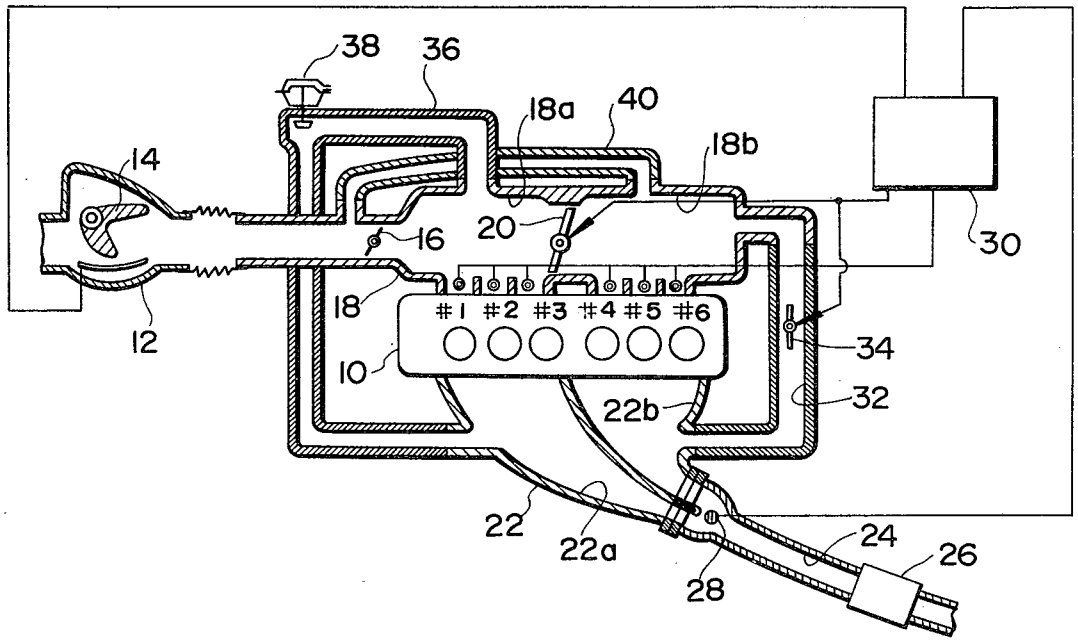
FIG. 2 is a schematic sectional combustion engine made in accordance with the present invention.

Referring to FIG. 2, there is illustrated one embodiment of a split engine made in accordance with the present invention. The engine comprises an engine block 10 containing therein an active cylinder unit including three cylinders #1 to #3 which are always active and an inactive cylinder unit having three cylinders #4 to #6 which are rendered inactive when the engine load is below a predetermined value.

Air is supplied to the engine through an air induction passage 12 provided therein with an airflow meter 14 and a throttle valve 16 being drivingly connected to the accelerator pedal (not shown) for controlling the flow of air to the engine. The induction passage 12 is connected downstream of the throttle valve 16 to an intake manifold 18 which is divided into first and second intake passages **18*a* and 18*b*. The first intake passage 18*a* leads to the active cylinders #1 to #3 and the second intake passage 18*b* leads to the inactive cylinders #4 to #6. The second intake 18*b* is provided at its entrance with a stop valve 20 which is adapted to close so as to cut off the flow of air to the inactive cylinders #4 to #6** at low load conditions.

The engine also includes an exhaust manifold 22 which is divided into first and second exhaust passages **22*a* and 22*b* leading from the active cylinders #1 to #3 and the inactive cylinders #4 to #5, respectively. The exhaust manifold 22 is connected at its downstream end to a front tube 24. A three-way catalytic converter 26 is located at the downstream end of the front tube 24 for effecting oxidation of HC and CO and reduction of NOx so as to minimize the emission of pollutants to the ambient. The performance of the catalytic converter 26 becomes maximum around stoichiometric air/fuel ratio condition and above a predetermined temperature. An air/fuel ratio sensor 28 is provided in the front tube 24. The air/fuel ratio sensor 28 may provide a feedback signal from the engine exhaust to a control circuit 30 so as to ensure that the fuel supplied to the engine is correct to maintain the stoichiometric air/fuel ratio. This leads to the improved performance of the catalytic converter 26** and fuel economy, and output efficiency.

A first exhaust gas recirculation (EGR) passage 32 is provided which has its one end opening into the second exhaust passage 226 and the other end thereof opening into the second intake passage **18*b*. The first EGR passage 32 has therein a first EGR valve 34 which is adapted to open to allow recirculation of exhaust gases, substantially at atmospheric pressure, into the second intake passage 18*b* during a split engine mode of operation. A second EGR passage 36 is provided which has its one end opening into the first exhaust passage 22*a* and the other end thereof opening into the first intake passage 18*a*. The second EGR passage 36 has therein a second EGR valve 38 which is adapted to open to a predetermined degree so as to allow recirculation of a predetermined amount of exhaust gases into the first intake passage 18*a*** for reducing the formation of NOx.

A bypass passage 40 is provided which has its one end opening into the induction passage 12 upstream of the throttle valve 16 and the other end thereof opening into the second intake passage **18*b* for introduction of a predetermined amount of air into the inactive cylinders #4 to #6** during a split engine mode of operation.

At low load conditions, the control circuit 30 renders the fuel injection means associated with the inactive cylinders #4 to #6 inoperative to cut off the supply of fuel thereto and the stop valve 20 closed to shut off the flow of air to the inactive cylinder #3 to #6 so as to place the engine operation in a split engine mode. During the split engine mode, the first EGR valve 34 opens to allow recirculation of exhaust gases, substantially at atmospheric pressure, into the inactive cylinders #4 to #6 to reducing pumping losses therein and also the second EGR valve 38 opens to a predetermined degree to allow recirculation of a predetermined amount of exhaust gases into the active cylinder #1 to #3 to reduce the formation of NOx.

In spite of such recirculation of exhaust gase into the active cylinders #1 to #3, the formation of NOx is relatively high and the exhaust gas temperature is relatively low, causing reduction in exhaust gas purifying performance of the catalytic converter 26. In order to minimize the emission of NOx to the ambient, it is necessary to increase the temperature of the catalytic converter 26 so that is can achieve its maximum performance, particularly its NOx purifying performance.

This is accomplished, in accordance with the present invention, by introducing a predetermined amount of air through the bypass passage 40 into the second intake passage **18*b*. A part of the introduced air flows into the first EGR passage 32 and the remainder flows into the inactive cylinders #4 to #6 to dilute the exhaust gases discharged therefrom. The diluted exhaust gases flow through the second exhaust passage 22*b* over the air/fuel ratio sensor 28 which thereby provides a control signal such that the air/fuel ratio of the mixture supplied to the active cylinder #1 to #3 is enriched above the stoichiometric condition. This produces exhaust gases including an increased amount of unburned substances from the active cylinders #1 to #3. Such exhaust gases are discharged through the first exhaust passage 22*a* and mixed with the diluted exhaust gases, which include an increased amount of oxygen, discharged from the inactive cylinders #4 to #6. Then, the mixed exhaust gases flows through the front tube 24 into the catalytic converter 26. The mixed exhaust gases include a considerable amount of unburned substances and oxygen so that oxidation is readily carried out in the catalytic converter 26 to immediately increase the catalytic converter temperature above a sufficient level. In addition, the mixed exhaust gases are considered as the result of imperfect combustion of a mixture maintained at the stoichiometric air/fuel ratio under the control of the air/fuel ratio sensor 28. Accordingly, the catalytic converter 26** exhibits its maximum performance to effect oxidation of unburned HC and CO and reduction of NOx.

In the presence of recirculated exhaust gases substantially at atmosphere pressure in the second intake passage **18*b*, the amount of air flowing through the bypass passage 40 into the second intake passage 18*b* is too small to cause a large fuel economy penalty in the active cylinders #1 to #3 although the mixture introduced into the active cylinders #1 to #3 becomes somewhat rich. As necessary, an orifice or other suitable means may be provided in the bypass passage 40 to meter the flow of air therethrough to a proper level. Furthermore, exhaust gases resulting from combustion of a rich mixture in the active cylinders #1 to #3 are recirculated through the second EGR passage 36 into the first intake passage 18*a*. This is effective to suppress the formation of NOx in the active cylinders #1 to #3**.

When the engine load increases above a given value, the fuel injection means associated with the inactive cylinders #4 to #6 becomes operative to resume the supply of fuel into the inactive cylinders #4 to #6 and the stop valve 20 openes to allow the flow of air into the inactive cylinders #4 to #6 so as to shift the engine operation into a full engine mode where the engine operates on all of the cylinders #1 to #6. During such full engine mode of operation, the first EGR valve 34 closes to stop recirculation of the exhaust gases from the second exhaust passage 226 into the second intake passage **18*b*, while the second EGR valve 38 continuously opens to allow recirculation of a predetermined amount of exhaust gases from the first exhaust passage 22*a* into the first intake passage 18*a***.

During a full engine mode of operation, it is not necessary to close the bypass passage 40 since the bypass passage 40 opens at its upstream end into the air induction passage 12 and thus the amount of fuel supplied to the engine can be determined accurately in accordance with the rate of air flow through the induction passage 12. In addition, the exhaust gas temperature is sufficiently high to maintain the catalytic converter 26 above a sufficient level.

Figure 3:
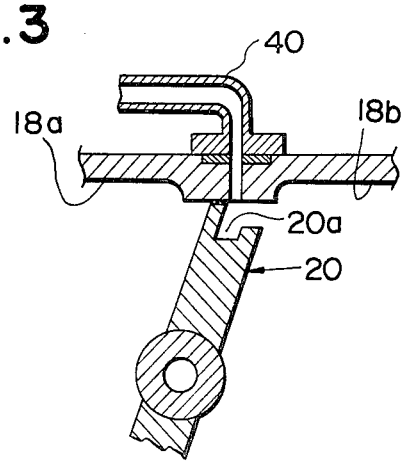
FIG. 3 is a fragmentary sectional view showing a significant portion of a second embodiment of the present invention.

Referring to FIG. 3, there is illustrated a second embodiment of the present invention which differs from the first embodiment only in that the stop valve 20 is formed in its outer peripheral surface with an annular groove **20*a* opening toward the second intake passage 18*b* and in that the bypass passage 40 has its downstream opening formed in registry with the annular groove 20*a* at the closed position of the stop valve 20. When the stop valve 20 is closed, air, substantially at atmospheric pressure, is introduced through the bypass passage 40 into the annular groove 20*a* to form an air layer around the stop valve 20. This is effective to prevent escape of exhaust gases charged in the second intake passage 18*b* into the first intake passage 18*a***.

Figure 4:
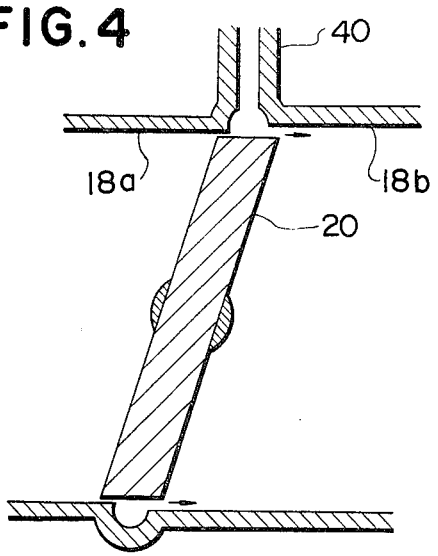
FIG. 4 is a fragmentary sectional view showing a modified form of FIG. 3.

FIG. 4 illustrates a modification of the structure of FIG. 3 in which the bypass passage 40 has its downstream opening formed in registry with the outer peripheral surface of the stop valve 20 and the intake passage has a larger diameter downstream of the stop valve 20 than upstream of the stop valve 20.

During a split engine mode of operation, a constant amount of air is supplied through the bypass passage 40 into the second intake passage 18*b* since the suction vacuum created by the inactive cylinder #4 to #6 is maintained constant under the control of the first EGR valve 34. The air introduced into the second intake passage 18*b* has a larger effect on the air/fuel ratio of a mixture produced in the active cylinders #1 to #3 at very low load conditions such as idle conditions where a small amount of exhaust gases are discharged from the active cylinders #1 to #3 than at relatively high load conditions where a large amount of exhaust gases are discharged from the active cylinders #1 to #3. In view of the fact that the special problems involved with a reduction in the temperature of the catalytic converter 26 become serious particularly at very low load conditions such as idle conditions, it is preferable from the fuel economy standpoint to introduce air into the inactive cylinders #4 to #6 only at these conditions.

Figure 5:
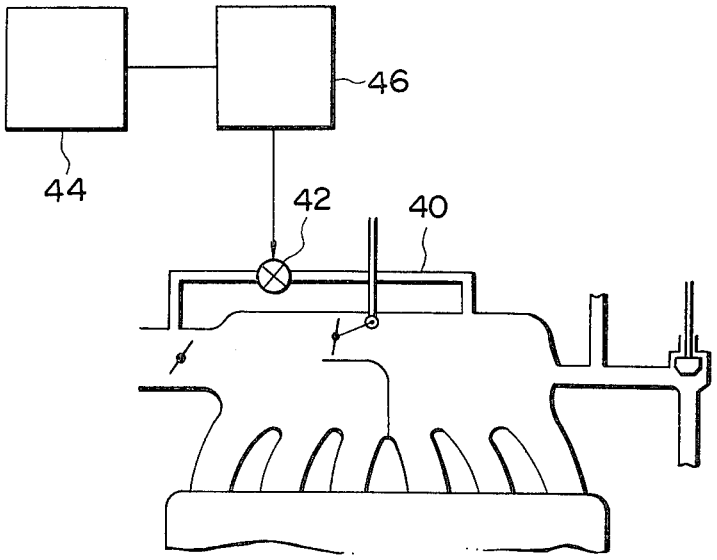
FIG. 5 is a schematic view showing a third embodiment of the present invention.

Referring to FIG. 5, the bypass passage 40 is provided therein with a control valve 42 for closing and opening the bypass passage 40. An idle condition sensor 44 is provided which is adapted to provide a control signal when the engine is idling. The idle condition sensor 44 may include a throttle switch adapted to become conductive when the throttle valve is at its closed position. The control signal is applied to a valve actuator 46 which thereby opens the control valve 42 to allow the flow of air through the bypass passage 40 into the second intake passage 18*b*. It is to be noted, of course, that the valve actuator 46 may be associated with means responsive to a exhaust gas temperature drop and/or catalytic converter temperature drop for providing a control signal to the valve actuator 46, thereby opening the control valve 42.

The above described split engine of the present invention has a bypass passage for introducing fresh air into the inactive cylinders to dilute exhaust gases discharged therefrom. The diluted exhaust gases flow over the air/fuel ratio sensor which thereby provides a control signal such that the air/fuel ratio of the mixture supplied to the active cylinders can be enriched above the stoichiometric condition. This produces exhaust gases including an increased amount of unburned substances from the active cylinders. Such exhaust gases are mixed with the diluted exhaust gases including an increased amount of oxygen discharged from the inactive cylinders and the mixed exhaust gases flows into the three-way catalytic converter in which oxidation is rapidly carried out to immediately increase the catalytic converter temperature above a sufficient level. Additionally, the exhaust gases flowing into the catalytic converter is the result of imperfect combustion of a mixture maintained at the stoichiometric air/fuel ratio under the control of the air/fuel ratio sensor. Accordingly, the catalytic converter exhibits its maximum performance to oxize HC and CO and reduce NOx.

While the present invention has been described in connection with a 6-cylinder engine, it is to be noted that the particular engine shown is only for illustrative purposes and the structure of this invention could be readily applied to any split engine structure. While the present invention has been described in conjunction with a specific embodiment thereof, it is evident that many alternatives, modifications and variations will be apparent to those skilled in the art. Accordingly, it is intended to embrace all alternatives, modifications and variations that fall within the spirit and broad scope of the appended claims.

What is claimed is:

1. An internal combustion engine comprising:

(a) first and second cylinder units each including at least one cylinder;

(b) an intake passage provided therein with a throttle valve and divided downstream of said throttle valve into first and second branches leading to said first and second cylinder units, respectively;

(c) a stop valve provided at or near an entrance of said intake passage second branch;

(d) an exhaust passage leading from said first and second cylinder unit;

(e) an air/fuel ratio sensor located in said exhaust passage for providing a signal indicative of the air/fuel ratio sensed from the engine exhaust;

(f) a three-way catalytic converter located in said exhaust passage downstream of said air/fuel ratio sensor;

(g) an EGR passage connecting said exhaust passage to said intake passage second branch downstream of said stop valve;

(h) an EGR valve provided in said EGR passage;

(i) control means, responsive to low engine load conditions, for disabling said second cylinder unit, closing said stop valve to disconnect said intake passage second branch from said intake passage, and opening said EGR valve to permit recirculation of exhaust gases into said second cylinder unit, said control means also being responsive to said air/fuel ratio sensor, for maintaining the air/fuel ratio at which said engine is operating at a desired value; and (j) a bypass passage opening at its one end into said intake passage upstream of said throttle valve and at the other end into said intake passage second branch downstream of said stop valve for introducing air into said intake passage second branch and mixing air with exhaust gases recirculated into said intake passage second branch at low engine load conditions.

2. An internal combustion engine according to claim 1, wherein said stop valve comprises a valve plate formed in its outer peripheral surface with an annular groove opening toward said intake passage second branch and said bypass passage has its downstream opening formed in registry with the annular groove at the closed position of said stop valve.

3. An internal combustion engine according to claim 1, wherein said bypass passage has its downstream opening formed in registry with the outer peripheral surface of said stop valve and wherein said intake passage has a larger diameter downstream of said stop valve at said second branch than upstream of said stop valve at said first branch.

4. An internal combustion engine according to claim 1, which further comprises a normally closed control valve provided in said bypass passage, means for detecting idle conditions to provide a control signal, and means responsive to the control signal to open said control valve.

5. An internal combustion engine according to claim 4, wherein said idle condition detecting means includes a throttle switch adapted to become conductive when said throttle valve is at its closed position.

* * * * *